US010333188B2

(12) United States Patent
Yuan et al.

(10) Patent No.: US 10,333,188 B2
(45) Date of Patent: Jun. 25, 2019

(54) TRANSVERSE MAGNETIC (TM) MODE DIELECTRIC FILTER

(71) Applicant: HUAWEI TECHNOLOGIES CO., LTD., Shenzhen (CN)

(72) Inventors: Bengui Yuan, Shanghai (CN); Ling Guo, Shanghai (CN); Qun Fang, Shanghai (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 137 days.

(21) Appl. No.: 15/343,742

(22) Filed: Nov. 4, 2016

(65) Prior Publication Data

US 2017/0077573 A1 Mar. 16, 2017

Related U.S. Application Data

(63) Continuation of application No. PCT/CN2014/076963, filed on May 7, 2014.

(51) Int. Cl.
*H01P 1/201* (2006.01)
*H01P 7/10* (2006.01)
(Continued)

(52) U.S. Cl.
CPC ..... *H01P 1/201* (2013.01); *H01P 1/207* (2013.01); *H01P 1/2084* (2013.01); *H01P 7/10* (2013.01)

(58) Field of Classification Search
CPC .. H01P 1/207; H01P 1/201; H01P 7/10; H01P 1/2084
(Continued)

(56) References Cited

U.S. PATENT DOCUMENTS 4,639,699 A 1/1987 Nishikawa et al.
2011/0128097 A1 6/2011 Park et al.
2013/0176088 A1 7/2013 Mao et al.

FOREIGN PATENT DOCUMENTS

CN 101546857 9/2009
CN 201673986 12/2010
(Continued)

OTHER PUBLICATIONS

English translation of CN103035980; Apr. 10, 2013; Shenzhen Tatfook Technology Co.*
(Continued)

*Primary Examiner* — Rakesh B Patel
(74) *Attorney, Agent, or Firm* — Staas & Halsey LLP

(57) ABSTRACT

A transverse magnetic (TM) mode dielectric filter includes an enclosure, a dielectric resonator, a main cover, and an elastic component, where the dielectric resonator is disposed in a resonant cavity of the enclosure; the main cover is secured between the elastic component and an open end of the enclosure; the elastic component includes multiple elastic flaps; the multiple elastic flaps are evenly distributed around an axial direction of the dielectric resonator; one end of each of the elastic flaps is fixedly connected to the main cover, and free ends of the elastic flaps elastically act on a central part of an outer surface of the main cover, to provide an elastic force towards the dielectric resonator. The evenly distributed multiple elastic flaps produce a pressure towards the dielectric resonator. A uniform and stable pressure is produced around the dielectric resonator, to ensure a uniform current density inside the resonant cavity.

19 Claims, 4 Drawing Sheets

(51) Int. Cl.
*H01P 1/208* (2006.01)
*H01P 1/207* (2006.01)

(58) Field of Classification Search
USPC ..... 333/206–209, 219.1
See application file for complete search history.

(56) References Cited

FOREIGN PATENT DOCUMENTS

| | | |
|---|---|---|
| CN | 201749935 | 2/2011 |
| CN | 201804987 | 4/2011 |
| CN | 102044730 | 5/2011 |
| CN | 102113168 | 6/2011 |
| CN | 102136620 | 7/2011 |
| CN | 201946725 | 8/2011 |
| CN | 201966311 | 9/2011 |
| CN | 202004138 | 10/2011 |
| CN | 102324617 | 1/2012 |
| CN | 102368574 | 3/2012 |
| CN | 202167592 | 3/2012 |
| CN | 102496765 | 6/2012 |
| CN | 202308237 | 7/2012 |
| CN | 103035980 | 4/2013 |

OTHER PUBLICATIONS

International Search Report dated Feb. 13, 2015 in corresponding International Application No. PCT/CN2014/076963.
Chinese Search Report dated Mar. 17, 2017 in corresponding Chinese Patent Application No. 2014800327990.
Extended European Search Report dated Apr. 4, 2017 in corresponding European Patent Application No. 14891261.1.
Chinese Office Action dated Mar. 27, 2017, in corresponding Chinese Patent Application No. 201480032799.0.
International Search Report dated Feb. 13, 2015 in corresponding International Patent Application No. PCT/CN2014/076963.

* cited by examiner

TRANSVERSE MAGNETIC (TM) MODE DIELECTRIC FILTER

CROSS-REFERENCE TO RELATED APPLICATIONS

This application is a continuation of International Application No. PCT/CN2014/076963, filed on May 7, 2014, the disclosure of which is hereby incorporated by reference in its entirety.

TECHNICAL FIELD

The present invention relates to a filter, and in particular, to a transverse magnetic (TM) mode dielectric filter.

BACKGROUND

A filter, as a frequency selection apparatus, is widely applied to the communications field, and in particular, to the field of radio frequency communications. In a base station, a filter is used to select a communications signal, filter out a clutter signal or an interference signal beyond a communications signal frequency, and reserve a wanted signal within a passband. With a gradually growing mass production requirement for miniaturized, high-performance, and high-power filters in the communications field, a current metal coaxial cavity filter gradually becomes incapable of satisfying the requirement due to factors such as a large volume, a limited Q value and limited power, while a dielectric filter has a relatively high Qf and power capacity, and can implement miniaturization, and therefore has an obvious advantage.

A transverse magnetic (TM) mode dielectric filter has the foregoing advantage. However, in the TM filter, sufficient contact needs to be maintained between a dielectric resonator and upper and lower surfaces of a cavity in a long term to ensure good and stable performance, and therefore, how to secure the dielectric resonator becomes a key technology. A common TM mode dielectric filter includes a cavity, a dielectric resonator disposed in the cavity, and a main cover.

In the prior art, an elastic component, such as a gasket or a thin cover, that produces an elastic acting force on the dielectric resonator is usually disposed between the dielectric resonator and the main cover, to achieve the purpose of securing the dielectric resonator. Because part of the elastic component is located within the cavity, in order to ensure electrical performance, the whole elastic component needs to be electroplated, causing a complex process and relatively high processing costs; besides, to produce an elastic force, the elastic component is bent to some degree in the cavity, causing a non-uniform current distribution and affecting the electrical performance. High-precision fitting is required between the elastic component and the cavity, between the elastic component and the main cover, and between the elastic component and a dielectric, increasing the processing and assembly difficulty.

SUMMARY

The present invention provides a transverse magnetic (TM) mode dielectric filter, which has a low precision control requirement and low costs and can ensure high reliability of electrical performance, thereby improving intermodulation performance and ensuring long-term stability.

A transverse magnetic (TM) mode dielectric filter is provided, including an enclosure, a dielectric resonator, a main cover, and an elastic component, where a columnar resonant cavity is formed in the enclosure, and the enclosure is disposed with an opening at an end located at the resonant cavity;

the dielectric resonator is columnar, is disposed in the resonant cavity, and is disposed coaxially with the resonant cavity; and one end of the dielectric resonator abuts against a bottom surface of the resonant cavity, where the main cover is secured between the elastic component and an open end of the enclosure;

the main cover has an inner surface and an outer surface that are opposite to each other; a central part of the inner surface of the main cover is adhered to the other end of the dielectric resonator, and a periphery of the main cover is adhered to the open end of the enclosure; and the elastic component includes multiple elastic flaps; the multiple elastic flaps are evenly distributed around an axial direction of the dielectric resonator; one end of each of the elastic flaps is fixedly connected to the main cover, and the other end of each of the elastic flaps extends towards a central axis of the dielectric resonator to form a free end; and the free ends of the elastic flaps elastically act on a central part of the outer surface of the main cover, to provide an elastic force towards the dielectric resonator.

In a first possible implementation manner, the inner surface of the main cover is a plane, and an end surface of the other end of the dielectric resonator is flush with an end surface of the open end of the enclosure.

With reference to either of the foregoing implementation manners, in a second possible implementation manner, a first boss is disposed at the central part of the outer surface of the main cover, and the first boss protrudes along the central axis of the dielectric resonator and forms a protruding surface; and the free ends of the elastic flaps elastically abut against the protruding surface, so that the elastic flaps are elastically deformed.

With reference to the foregoing second possible implementation manner, in a third possible implementation manner, shapes of outer edges of a cross-section of the first boss and a cross-section of the dielectric resonator are the same, and an outer diameter of the first boss is equal to or slightly greater than an outer diameter of the dielectric resonator.

With reference to any of the foregoing implementation manners, in a fourth possible implementation manner, an annular slot is disposed between a periphery and the central part of the outer surface of the main cover.

With reference to any of the foregoing implementation manners, in a fifth possible implementation manner, the elastic component further includes a positioning ring, and the positioning ring is disposed around the central axis of the dielectric resonator and is fixedly connected to the periphery of the outer surface of the main cover; and the elastic flaps are secured to an inner side of the positioning ring, and one end of the elastic flap is fixedly connected to the main cover by using the positioning ring.

With reference to the fifth possible implementation manner, in a sixth possible implementation manner, the positioning ring and the multiple elastic flaps are integrally formed.

With reference to the sixth possible implementation manner, in a seventh possible implementation manner, by means of mechanical processing on a board disposed with a through-hole at a center, the elastic component is disposed with multiple strip slots at the through-hole, the strip slot has one end closed and the other end open, and the open end of the strip slot is in communication with the through-hole; and the elastic flap is formed between two adjacent strip slots, and the positioning ring is formed at the closed end of the strip slot.

With reference to any of the foregoing implementation manners, in an eighth possible implementation manner, the TM mode dielectric filter further includes a tuning screw and a nut; the dielectric resonator is of a hollow columnar structure;

a screw hole is disposed at a center of the main cover, the tuning screw is in threaded connection to the screw hole, one end of the tuning screw is located in the dielectric resonator, and a gap is disposed between the tuning screw and an inner wall of the dielectric resonator; and the nut is in threaded connection to the tuning screw and abuts against the main cover.

With reference to the eighth possible implementation manner, in a ninth possible implementation manner, a second boss is further disposed at a central part of the main cover, and the second boss protrudes along the central axis of the dielectric resonator; the screw hole is disposed in the second boss, the nut abuts against the second boss, and the free ends of the multiple elastic flaps are located on a periphery of the second boss.

With reference to the ninth possible implementation manner, in a tenth possible implementation manner, in a case in which the first boss is disposed at the central part of the outer surface of the main cover, the second boss is disposed on the first boss, connection between the second boss and the first boss is step-like, and the protruding surface is an annular step plane surrounding the second boss.

In the TM mode dielectric filter provided in the present invention, the main cover fits with the enclosure and the dielectric resonator in an adhering manner; the elastic component is disposed on the outer surface of the main cover, and the elastic component does not need to be electroplated, which reduces processing costs; an acting force is transferred by using the main cover, high precision is not required between the elastic component and the dielectric resonator, and a requirement on tolerance is low, reducing processing costs; a pressure towards the dielectric resonator is produced by the multiple elastic flaps that are evenly distributed, and the pressure is transferred to the dielectric resonator by using the main cover, so that a pressure applied to an end surface of the dielectric resonator is uniformly and stably distributed in an axial direction, to ensure a uniform current density inside the resonant cavity and ensuring electrical performance. In this way, intermodulation performance can be greatly improved and kept stable in a long term, thereby preventing the dielectric resonator from breaking.

BRIEF DESCRIPTION OF DRAWINGS

To describe the technical solutions in the embodiments of the present invention more clearly, the following briefly describes the accompanying drawings required for describing the embodiments. Apparently, the accompanying drawings in the following description show merely some embodiments of the present invention, and persons of ordinary skill in the art may still derive other drawings from these accompanying drawings without creative efforts.

DESCRIPTION OF EMBODIMENTS

The following describes the technical solutions in the embodiments of the present invention with reference to the accompanying drawings in the embodiments of the present invention. Apparently, the described embodiments are merely some but not all of the embodiments of the present invention. All other embodiments obtained by persons of ordinary skill in the art based on the embodiments of the present invention without creative efforts shall fall within the protection scope of the present invention.

Figure 1:
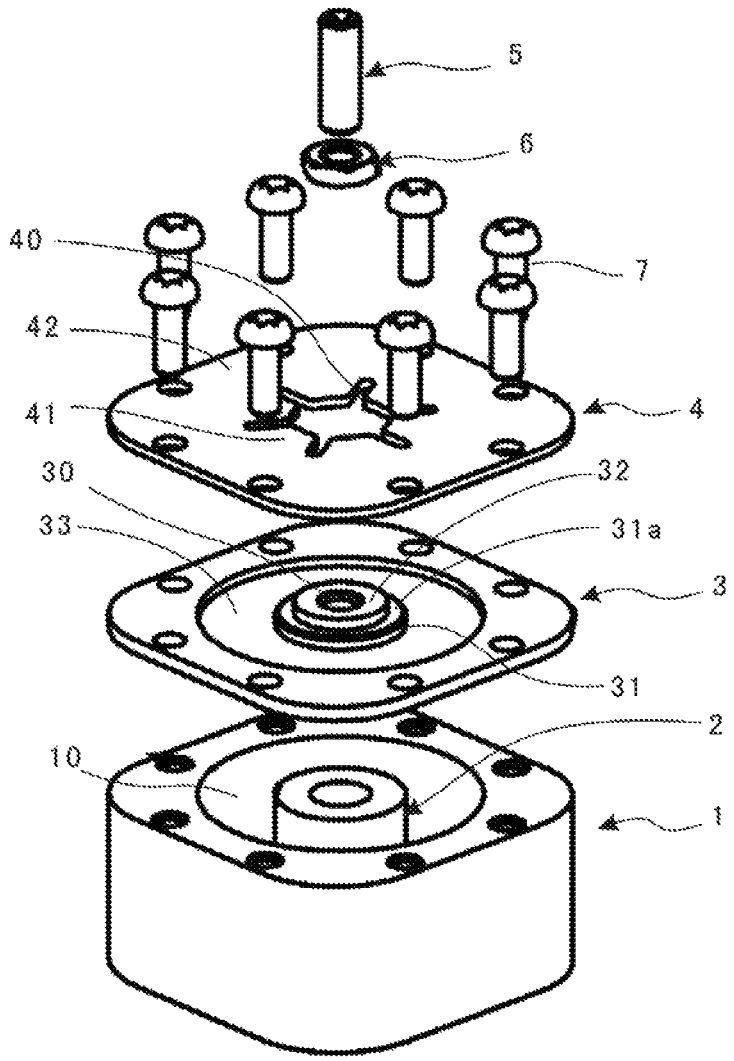
FIG. 1 is an exploded schematic diagram of a TM mode dielectric filter according to a possible implementation manner of the present invention.
Figure 2:
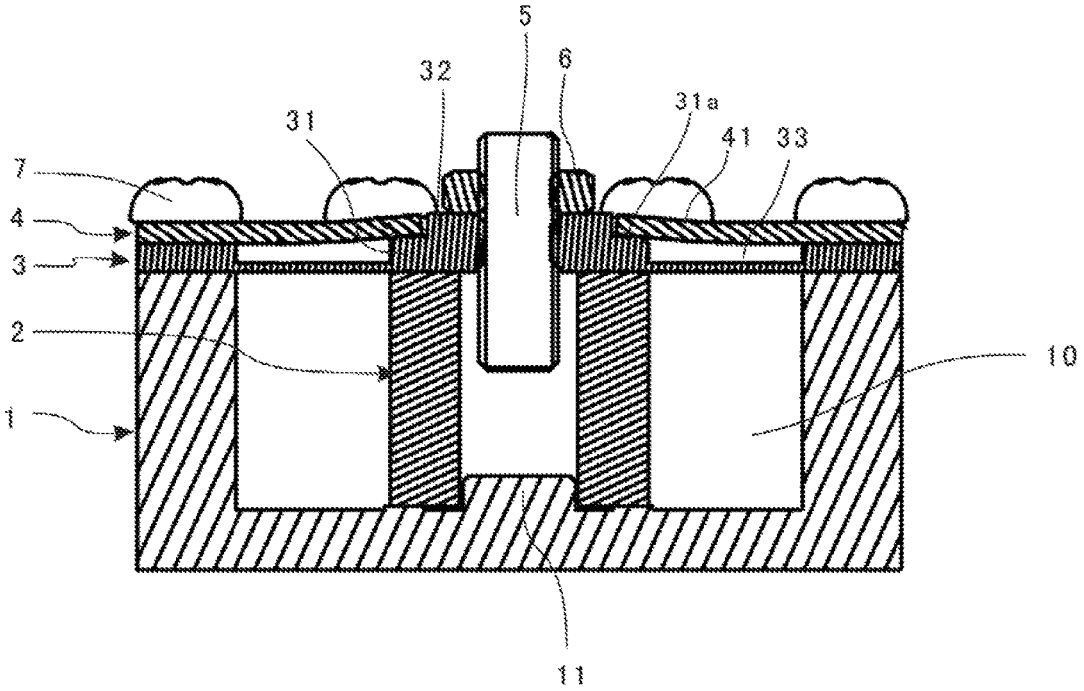
FIG. 2 is an axial sectional view of the TM mode dielectric filter in FIG. 1.
Figure 3:
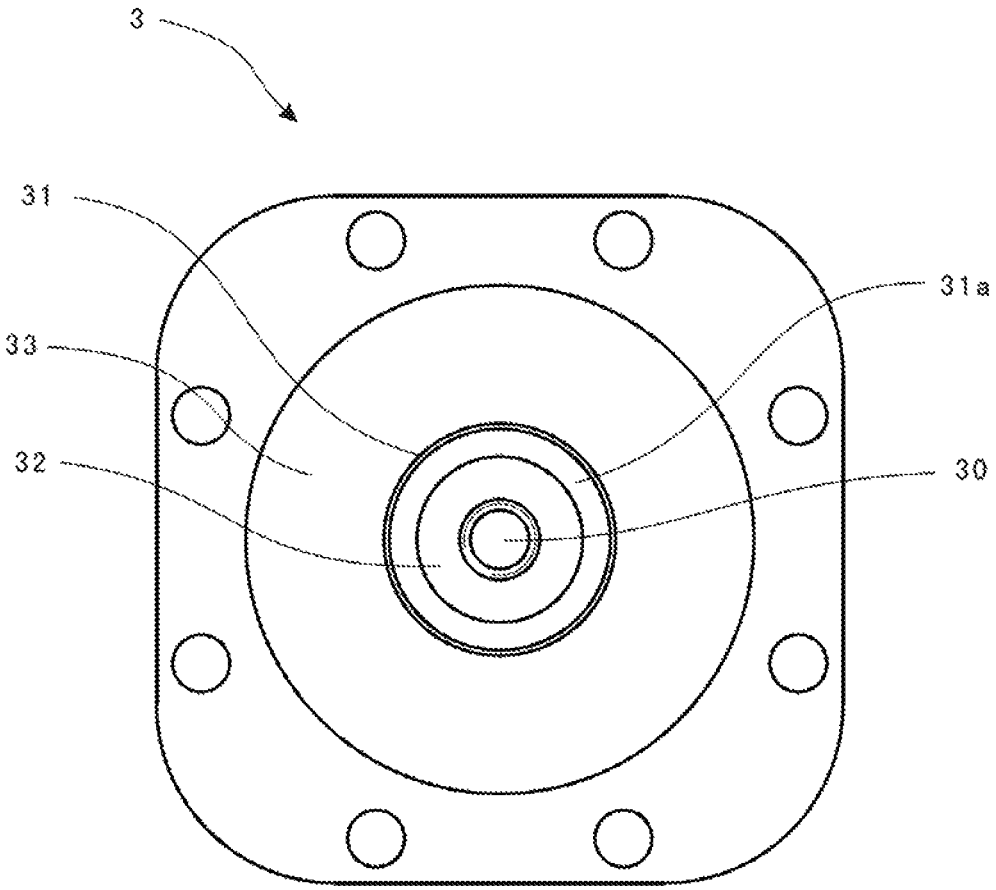
FIG. 3 is a schematic diagram of a main cover of the TM mode dielectric filter in FIG. 1.
Figure 4:
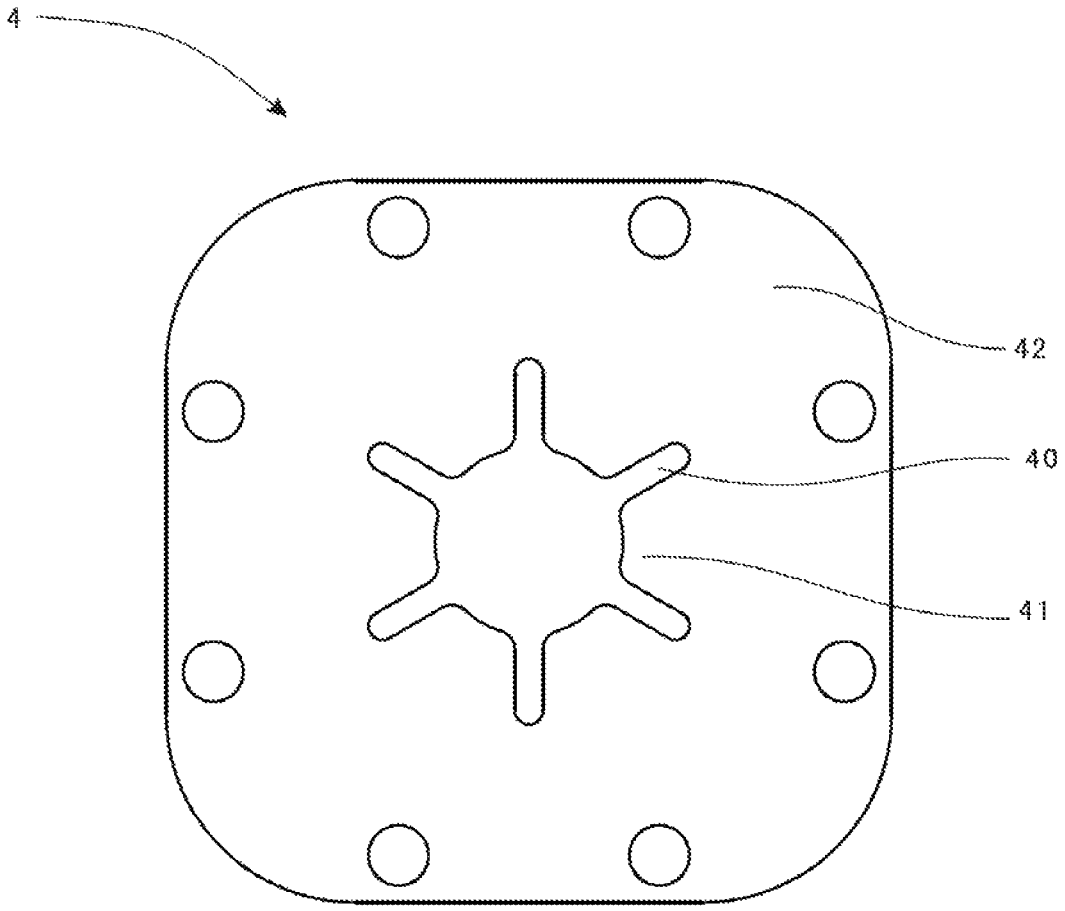
FIG. 4 is a schematic diagram of an elastic component of the TM mode dielectric filter in FIG. 1.

As shown in FIG. 1 to FIG. 4, the present invention provides a transverse magnetic (TM) mode dielectric filter, and the TM mode dielectric filter may be a TM01 main mode dielectric filter or certainly, may be a TM mode dielectric filter in another form. The TM mode dielectric filter includes an enclosure 1, a dielectric resonator 2, a main cover 3, and an elastic component 4. The main cover 3 and the elastic component 4 are secured to the enclosure 1, and the dielectric resonator 2 is secured in the enclosure 1; and the elastic component 4 may provide an elastic force to the main cover 3, so that a uniform downward pressure is applied from the main cover 3 to an upper end surface of the dielectric resonator 2, thereby improving intermodulation performance of the dielectric resonator 2.

A columnar resonant cavity 10 is formed in the enclosure 1, and the enclosure 1 is disposed with an opening at an end located at the resonant cavity 10. The enclosure 1 is made of a metal material or a plastic alloy material and includes some metal elements having an effect of shielding an electromagnetic wave. The dielectric resonator 2 is columnar, is disposed in the resonant cavity 10, and is disposed coaxially with the resonant cavity 10; one end of the dielectric resonator 2 abuts against a bottom surface of the resonant cavity 10. The dielectric resonator 2 is generally made of a ceramic dielectric and may be doped with rare metals such as rare earth. In this embodiment, the dielectric resonator 2 is of a hollow columnar structure. It can be understood that in the field of TM mode dielectric filters, that dielectric resonator 2 is of a hollow columnar structure refers to that the dielectric resonator 2 is columnar as a whole, and is disposed with a through-hole running through the dielectric resonator 2 at a central axis position of the dielectric resonator 2.

In this embodiment, a positioning structure fitting with the dielectric resonator 2 is disposed at a central position of a bottom surface of the resonant cavity 10. In this embodiment, the dielectric resonator 2 is of a hollow columnar structure, the positioning structure is a boss 10, an outer diameter of the positioning boss 10 fits with an inner diameter of the dielectric resonator 2, and an outer diameter of a positioning boss 11 fits with an inner diameter dimension of the dielectric resonator 2 and tolerance, to implement positioning between a bottom end of the dielectric resonator 2 and the enclosure 1 and ensure that the dielectric resonator 2 does not become loose when mounted on the positioning boss 11 on the bottom surface of the resonant cavity 10; besides, in this case, the dielectric resonator 2 is in a free state and can be replaced. Herein, in another implementation manner, the positioning structure may be a positioning blind via, where an aperture of the positioning blind via fits with the outer diameter of the dielectric resonator, and the dielectric resonator 2 is of a hollow structure or is a solid column, with one end capable of being inserted into the positioning blind via to implement positioning.

The main cover 3 includes an inner surface and an outer surface that are opposite to each other. Herein, it can be understood that the inner surface of the main cover 3 is a surface located inside the resonant cavity 10, and the outer surface is a surface, located outside the resonant cavity 10, of the main cover 3. A central part of the inner surface of the main cover 3 is adhered to the other end of the dielectric resonator 2, and a periphery of the main cover 3 is adhered to an open end of the enclosure 1. Preferably, the inner surface of the main cover 3 is a plane, and an end surface of the other end of the dielectric resonator 2 is flush with an end surface of the open end of the enclosure 1. In this embodiment, a height of the dielectric resonator 2 is the same as a depth of the resonant cavity 10; after the main cover 3 and the enclosure 1 are assembled, the periphery of the main cover 3 is adhered to the open end of the enclosure 1, and a central part of the main cover 3 can abut against and be adhered to the dielectric resonator 2, to facilitate assembly and connection and lower processing difficulty. The inner surface of the main cover 3 is a plane, which can ensure a uniform current distribution in the resonant cavity and ensure electrical performance of the filter. Herein, in another implementation manner, the inner surface of the main cover 3 may not be a plane; a protrusion may be disposed at the central part of the main cover 3, and the protrusion can abut against an end surface of the dielectric resonator 2 and make the end surface of the dielectric resonator 2 not flush with the end surface of the open end of the enclosure 1.

In this embodiment, because only the inner surface of the main cover 3 is located in the resonant cavity 10, only the inner surface of the main cover 3 needs to be electroplated to ensure electrical performance in the resonant cavity 10, and the outer surface may be electroplated or may not be electroplated, to reduce processing operations and processing costs. The main cover 3 is made of a metal material; for example, the main cover 3 may be made of aluminum, copper, steel, or any material with conductive performance; the main cover 3 may be implemented by means of machining or die casting.

The elastic component 4 is disposed on the outer surface of the main cover 3, and the elastic component 4 includes a positioning ring 42 and multiple elastic flaps 41. The positioning ring 42 is disposed around a central axis of the dielectric resonator 2 and is fixedly connected to a periphery of the outer surface of the main cover 3. The elastic flaps 41 are secured to an inner side of the positioning ring 42, one end of the elastic flap 41 is fixedly connected to the main cover 3 by using the positioning ring 42, and use of the positioning ring 42 can facilitate assembly and connection of the multiple elastic flaps 41. The multiple elastic flaps 41 are evenly distributed around an axial direction of the dielectric resonator 2. The elastic flaps 41 extend towards the central axis of the dielectric resonator 2 to form free ends; the free ends of the elastic flaps 41 elastically act on a central part of the outer surface of the main cover 3, to provide an elastic force towards the dielectric resonator 2. The elastic flap 41 is elastic, where the free end moves relatively, and an elastic force can be produced by means of elastic deformation of the elastic flap 41.

Because multiple elastic flaps 41 are provided and are evenly distributed around the dielectric resonator 2, a uniform pressure towards the dielectric resonator 2 can be produced on the periphery of the dielectric resonator 2, ensuring that a pressure applied to the main cover 3 is uniformly distributed on the periphery; a uniform downward pressure is also applied from the main cover 3 to an upper end surface of the dielectric resonator 2, ensuring a uniform current density inside the resonant cavity 10. Therefore, intermodulation performance of the dielectric resonator 2 can be improved. The pressure is distributed uniformly and stably, therefore avoiding a problem that when the temperature cyclically changes, the dielectric resonator 2 breaks due to interference or an excessive pressure of the dielectric resonator 2 caused by a relatively large amount of accumulated tolerance.

Preferably, the elastic flap 41 and the positioning ring 42 are both tabular, and the elastic flap 41 in a free state is flush with the positioning ring 42, to facilitate processing and preparation. The positioning ring 42 and the multiple elastic flaps 41 may be integrally formed; by means of mechanical processing, such as machining stamping, linear cutting, laser cutting or the like on a board disposed with a through-hole at a center, the elastic component 4 is disposed with multiple strip slots 40 at the through-hole along a radial direction; the strip slot 40 has one end closed and the other end open, and the open end of the strip slot 40 is in communication with the through-hole; the elastic flap 41 is formed between two adjacent strip slots 40, and the positioning ring 42 is formed at the closed end of the strip slot 40, to facilitate processing and preparation. A quantity and sizes of the elastic flaps 41 can be determined according to actual product requirements, and pressures produced by the elastic flaps 41 are also different depending on the quantity and the sizes of the elastic flaps 41. The elastic component 4 may be made of spring steel, so that the elastic component 4 has an advantage of having stable and enduring elasticity, ensuring that performance of the filter is stable in a long term and the performance remains unchanged even under a harsh ambient temperature. Herein, in another implementation manner, the elastic component 4 may also be made of a material capable of providing elasticity that is stable in a long term, for example, an elastic steel board or an elastic composite material.

In this embodiment, a first boss 31 is disposed at the central part of the outer surface of the main cover 3, and the first boss 31 protrudes along the central axis of the dielectric resonator 2 and forms a protruding surface 31*a*; on the central axis of the dielectric resonator 2, the protruding surface 31*a* of the first boss 31 is away from the dielectric resonator with respect to the periphery of the outer surface of the main cover 3, and the free ends of the elastic flaps 41 elastically abut against the protruding surface 31*a*. The first boss 31 can enable the central part of the main cover 3 to have a height difference with respect to the periphery of the main cover 3; after the elastic component 4, the main cover 3, and the enclosure 1 are assembled, the free ends of the elastic flaps 41 are enabled to move towards a direction away from the dielectric resonator 2, and the elastic flaps 41 are elastically deformed to produce an elastic force, providing a pressure to the first boss 31 and the dielectric resonator 2.

Shapes of outer edges of a cross-section of the first boss 31 and a cross-section of the dielectric resonator 2 are the same, and an outer diameter of the first boss 31 is equal to or is slightly greater than an outer diameter of the dielectric resonator 2, to ensure that the dielectric resonator is uniformly stressed. In this embodiment, the outer edge of the cross-section of the first boss 31 is circular, that is, the first boss 31 is cylindrical, and the outer edge of the cross-section of the dielectric resonator 2 is also circular. Correspondingly, both outer peripheries of the cross-sections of the first boss 31 and the dielectric resonator 2 may also be square or in another shape.

A second boss 32 may further be disposed at the central part of the main cover 3, and the second boss 32 protrudes along the central axis of the dielectric resonator 2; a screw hole 30 is disposed in the second boss 32, a nut 6 abuts against the second boss 32, and the free ends of the multiple elastic flaps 41 are located on a periphery of the second boss. The nut 6 and the elastic flaps 41 separately abut against different positions, and the use of the second boss 32 can prevent the nut 6 from touching the elastic flaps 41 when the nut 6 is rotated, avoiding affecting disassembly and assembly.

In this embodiment, the second boss 32 is disposed on the first boss 31, connection between the second boss 32 and the first boss 31 is step-like, and the protruding surface 31*a* is an annular step plane surrounding the second boss. A structure of the main cover 3 is set properly and can prevent the nut 6 from touching the elastic flaps 41 while ensuring effective deformation of the elastic flaps 41.

An annular slot 33 is disposed between the periphery and the central part of the outer surface of the main cover 3; a thickness of an area between the center and the periphery of the main cover 3 may be reduced by using the annular slot 33; the annular slot 33 can ensure that when a force acts on the first boss 31, a tensile force produced by deformation of the first boss 31 being stressed can be desirably absorbed in time by the annular slot 33; after the annular slot 33 is added, an area of the main cover 3 located at a lower position is thin enough, facilitating deformation of the central part of the main cover 3 relative to the periphery, and a counter acting force against the first boss 31 is relatively small, thereby ensuring that the force of the elastic flaps 41 is fully applied to the dielectric resonator 2.

In this embodiment, the TM mode dielectric filter may further include multiple fastening screws 7, and the multiple fastening screws 7 are evenly distributed along the open end of the enclosure 1, so that the elastic component 4 and the main cover 3 are uniformly stressed, ensuring electrical performance. The fastening screw 7 sequentially runs through the positioning ring 42 and the periphery of the main cover 3, to be connected to the open end of the enclosure 1 in a threaded manner; the elastic component 4 and the main cover 3 are secured to the enclosure 1 by using the fastening screws 7, facilitating assembly, disassembly and maintenance. The fastening screw 7 is made of a steel material, to ensure that the fastening screw 7 has particular mechanical strength and ensure reliability of connection between the elastic component 4, the main cover 3, and the enclosure 1. Herein, in another implementation manner, fixed connection between the elastic component 4, the main cover 3, and the enclosure 1 may also be implemented by means of welding, riveting, clamping, and the like.

The TM mode dielectric filter may further include a tuning screw 5 and the nut 6. The screw hole 30 is disposed at the center of the main cover 3, the tuning screw 5 is in threaded connection to the screw hole 30, and the nut 6 is in threaded connection to the tuning screw 5, to fasten the tuning screw 5 to the main cover 3. One end of the tuning screw 5 is located in the dielectric resonator 2, and a gap is disposed between the tuning screw 5 and an inner wall of the dielectric resonator 2; and filtering is implemented by means of tuning by the tuning screw 5. Herein, in another implementation manner, the dielectric resonator 2 may be a solid cylinder, and tuning is performed in another manner to implement filtering, without the need of setting the tuning screw 5 and the nut 6.

In the present invention, by means of fitting between structures of the elastic component 4 and the main cover 3, interference press fit is implemented by using the elasticity of the elastic flaps 31, the dielectric resonator 2 does not need to have a relatively large magnitude of interference, a pressure towards the dielectric resonator 2 is produced by using the multiple elastic flaps that are evenly distributed, so that a uniform and stable pressure is produced around the dielectric resonator 2, to ensure a uniform current density inside the resonant cavity 10 and ensure electrical performance. In this way, intermodulation performance can be greatly improved and kept stable in a long term, thereby avoiding a problem that a dielectric breaks under an ambient temperature due to improper pressure control. The main cover 3 fits with the enclosure 1 and the dielectric resonator 2 in an adhering manner, the elastic component 4 is disposed on the outer surface of the main cover 3, and the elastic component 4 does not need to be electroplated, which reduces processing costs, does not require high precision between the parts, and has a low requirement on tolerance, thereby reducing processing costs and effectively resolving problems of a large variety of parts, complex assembly, and a high precision requirement in the prior art.

Parts of the TM mode dielectric filter provided in the present invention are assembled and connected by means of threads rather than a welding solution; intermodulation performance can still be lifted by using the elastic component 4; and the dielectric resonator can be conveniently disassembled to be replaced, to facilitate assembly and maintenance of the TM mode dielectric filter.

In this embodiment, multiple TM mode dielectric filters may form a filter module, where multiple enclosures 1 may be an integrated structure, that is, multiple resonant cavities may be provided in a large enclosure; multiple elastic components may be integrally formed or may be multiple parts that fit with multiple resonators respectively.

The foregoing implementation manner is one specific implementation manner of the invention. In addition, in the foregoing implementation manner, some of technical features of the TM mode dielectric filter may be modified and replaced to achieve a same or similar technical effect; these modifications and replacements include, but are not limited to, one or more of the following implementation manners.

In the foregoing implementation manner, the elastic flap 41 and the positioning ring 42 are both tabular, to facilitate processing and preparation. It should be noted that the elastic flap 41 and the positioning ring 42 are not limited to being tabular. In other implementation manners, the elastic flap 41 may also be rod-shaped or columnar; and the positioning ring 42 may also be annular block-shaped, frame-shaped, or in another shape.

In the foregoing implementation manner, the multiple elastic flaps 41 are connected by using the positioning ring 42 to form an integrated structure, and the elastic flaps 41 are fixedly connected to the main cover by using the positioning ring. In another implementation manner, the elastic component 4 may include multiple elastic flaps 41 only; the elastic flaps 41 are mutually independent parts; the elastic flaps 41 may be fixedly connected to the main cover one by one; the elastic flap 41 is strip-shaped, where one end of the elastic flap 41 is directly fixedly connected to the main cover 41, for example, may be fastened by using a bolt; and the free end of the elastic flap 41 abuts against the first boss. Further, to facilitate positioning of the elastic flaps 41, multiple positioning structures may be disposed on the first boss; the positioning structures may be positioning holes, positioning bumps, positioning slots, and the like; the positioning structures are in one-to-one fitting with the free ends of the elastic flaps, to facilitate positioning of the free ends of the elastic flaps and ensure that the strip-shaped elastic flaps do not shift, so that the multiple elastic flaps are evenly arranged above the main cover around the first boss and are fastened by screws, making the arrangement more flexible.

In the foregoing implementation manner, a deformation effect of the elastic flaps 41 may be improved by using the first boss 31. In another implementation manner, the first boss 31 may not be disposed at the central part of the main cover 3; in a free state, the elastic flaps 41 are designed to be in a bent shape, and the free ends of the elastic flaps 41 are bent towards the dielectric resonator 2, so that the free ends of the elastic flaps 41 can directly abut against the central part of the outer surface of the main cover 3; after assembly, the free ends may move towards a direction away from the dielectric resonator so that the elastic flaps 41 are elastically deformed, to provide a pressure to the dielectric resonator.

In the foregoing implementation manner, the free ends of the elastic flaps 41 abut against the first boss, that is, the free ends of the elastic flaps 41 directly abut against the main cover, to apply an acting force to the central part of the main cover 3. In another implementation manner, a separate part may be disposed at the central part of the outer surface of the main cover to form a stressed component protruding from the main cover; the free ends of the elastic flaps 41 abut against the stressed component. For example, after the tuning screw, the nut, and the main cover are assembled, the elastic component is assembled, and the free ends of the elastic flaps 41 are made to abut against the nut, so as to use the nut as the stressed component; the elastic flaps indirectly apply an acting force to the main cover.

Finally, it should be noted that the foregoing embodiments are merely intended for describing the technical solutions of the present invention but not for limiting the present invention. Although the present invention is described in detail with reference to the foregoing embodiments, persons of ordinary skill in the art should understand that they may still make modifications to the technical solutions described in the foregoing embodiments or make equivalent replacements to some technical features thereof, without departing from the spirit and scope of the technical solutions of the embodiments of the present invention.

What is claimed is:

1. A transverse magnetic (TM) mode dielectric filter, comprising an enclosure, a dielectric resonator, a main cover, and an elastic component, wherein a columnar resonant cavity is formed in the enclosure, and the enclosure is disposed with an opening at an end located at the resonant cavity;

the dielectric resonator is columnar, is disposed in the resonant cavity, and is disposed coaxially with the resonant cavity; and one end of the dielectric resonator abuts against a bottom surface of the resonant cavity;

the main cover is secured between the elastic component and an open end of the enclosure;

the main cover has an inner surface and an outer surface that are opposite to each other, a central part of the inner surface of the main cover is adhered to the other end of the dielectric resonator, and a periphery of the main cover is adhered to the open end of the enclosure; and the elastic component comprises multiple elastic flaps; the multiple elastic flaps are evenly distributed around an axial direction of the dielectric resonator; one end of each of the elastic flaps is fixedly connected to the main cover, and the other end of each of the elastic flaps extends towards a central axis of the dielectric resonator to form a free end; and the free ends of the elastic flaps elastically act on a central part of the outer surface of the main cover, to provide an elastic force towards the dielectric resonator.

2. The TM mode dielectric filter according to claim 1, wherein the inner surface of the main cover is a plane, and an end surface of the other end of the dielectric resonator is flush with an end surface of the open end of the enclosure.

3. The TM mode dielectric filter according to claim 1, wherein a first boss is disposed at the central part of the outer surface of the main cover, and the first boss protrudes along the central axis of the dielectric resonator and forms a protruding surface; and the free ends of the elastic flaps elastically abut against the protruding surface, so that the elastic flaps are elastically deformed.

4. The TM mode dielectric filter according to claim 3, wherein shapes of outer edges of a cross-section of the first boss and a cross-section of the dielectric resonator are the same, and an outer diameter of the first boss is equal to or slightly greater than an outer diameter of the dielectric resonator.

5. The TM mode dielectric filter according to claim 1, wherein an annular slot is disposed between a periphery and the central part of the outer surface of the main cover.

6. The TM mode dielectric filter according to claim 1, wherein the elastic component further comprises a positioning ring, and the positioning ring is disposed around the central axis of the dielectric resonator and is fixedly connected to the periphery of the outer surface of the main cover; and the elastic flaps are secured to an inner side of the positioning ring, and one end of the elastic flap is fixedly connected to the main cover by using the positioning ring.

7. The TM mode dielectric filter according to claim 6, wherein the positioning ring and the multiple elastic flaps are integrally formed.

8. The TM mode dielectric filter according to claim 7, wherein by means of mechanical processing on a board disposed with a through-hole at a center, the elastic component is disposed with multiple strip slots at the through-hole, each of the strip slots has one end closed and the other end open, and the open end of each of the strip slots is in communication with the through-hole; and the elastic flap is formed between two adjacent strip slots, and the positioning ring is formed at the closed end of the strip slot.

9. The TM mode dielectric filter according to claim 1, wherein the TM mode dielectric filter further comprises a tuning screw and a nut; the dielectric resonator is of a hollow columnar structure; and a screw hole is disposed at a center of the main cover, the tuning screw is in threaded connection to the screw hole, one end of the tuning screw is located in the dielectric resonator, and a gap is disposed between the tuning screw and an inner wall of the dielectric resonator; and the nut is in threaded connection to the tuning screw and abuts against the main cover.

10. The TM mode dielectric filter according to claim 9, wherein a second boss is further disposed at a central part of the main cover, and the second boss protrudes along the central axis of the dielectric resonator; the screw hole is disposed in the second boss, the nut abuts against the second boss, and the free ends of the multiple elastic flaps are located on a periphery of the second boss.

11. The TM mode dielectric filter according to claim 10, wherein in a case in which a first boss is disposed at the central part of the outer surface of the main cover, the second boss is disposed on the first boss, connection between the second boss and the first boss is step-like, and a protruding surface of the first boss is an annular step plane surrounding the second boss.

12. The TM mode dielectric filter according to claim 1, wherein the periphery of the main cover is adhered to the open end of the enclosure by welding, riveting, bolting, or clamping.

13. A transverse magnetic (TM) mode dielectric filter, comprising an enclosure, a dielectric resonator, a main cover, and an elastic component, wherein a columnar resonant cavity is formed in the enclosure, and the enclosure is disposed with an opening at an end located at the resonant cavity;

the dielectric resonator is columnar, is disposed in the resonant cavity, and is disposed coaxially with the resonant cavity; and one end of the dielectric resonator abuts against a bottom surface of the resonant cavity;

the main cover is secured between the elastic component and an open end of the enclosure;

the main cover has an inner surface and an outer surface that are opposite to each other, a central part of the inner surface of the main cover is adhered to the other end of the dielectric resonator, and a periphery of the main cover is adhered to the open end of the enclosure; and the elastic component comprises multiple elastic flaps; the multiple elastic flaps are evenly distributed around an axial direction of the dielectric resonator; one end of each of the elastic flaps is fixedly connected to the main cover, and the other end of each of the elastic flaps extends towards a central axis of the dielectric resonator to form a free end; and the free ends of the elastic flaps elastically act on a central part of the outer surface of the main cover, to provide an elastic force towards the dielectric resonator, wherein a first boss is disposed at the central part of the outer surface of the main cover, and the first boss protrudes along the central axis of the dielectric resonator and forms a protruding surface; and the free ends of the elastic flaps elastically abut against the protruding surface, so that the elastic flaps are elastically deformed, and wherein shapes of outer edges of a cross-section of the first boss and a cross-section of the dielectric resonator are the same, and an outer diameter of the first boss is equal to or slightly greater than an outer diameter of the dielectric resonator.

14. The TM mode dielectric filter according to claim 13, wherein the inner surface of the main cover is a plane, and an end surface of the other end of the dielectric resonator is flush with an end surface of the open end of the enclosure.

15. The TM mode dielectric filter according to claim 13, wherein an annular slot is disposed between a periphery and the central part of the outer surface of the main cover.

16. The TM mode dielectric filter according to claim 13, wherein the elastic component further comprises a positioning ring, and the positioning ring is disposed around the central axis of the dielectric resonator and is fixedly connected to the periphery of the outer surface of the main cover; and the elastic flaps are secured to an inner side of the positioning ring, and one end of the elastic flap is fixedly connected to the main cover by using the positioning ring.

17. The TM mode dielectric filter according to claim 16, wherein the positioning ring and the multiple elastic flaps are integrally formed.

18. The TM mode dielectric filter according to claim 17, wherein by means of mechanical processing on a board disposed with a through-hole at a center, the elastic component is disposed with multiple strip slots at the through-hole, each of the strip slots has one end closed and the other end open, and the open end of each of the strip slots is in communication with the through-hole; and the elastic flap is formed between two adjacent strip slots, and the positioning ring is formed at the closed end of the strip slot.

19. A transverse magnetic (TM) mode dielectric filter, comprising an enclosure, a dielectric resonator, a main cover, and an elastic component, wherein a columnar resonant cavity is formed in the enclosure, and the enclosure is disposed with an opening at an end located at the resonant cavity;

the dielectric resonator is columnar, is disposed in the resonant cavity, and is disposed coaxially with the resonant cavity; and one end of the dielectric resonator abuts against a bottom surface of the resonant cavity;

the main cover is secured between the elastic component and an open end of the enclosure;

the main cover has an inner surface and an outer surface that are opposite to each other, a central part of the inner surface of the main cover is adhered to the other end of the dielectric resonator, and a periphery of the main cover is adhered to the open end of the enclosure; and the elastic component comprises multiple elastic flaps; the multiple elastic flaps are evenly distributed around an axial direction of the dielectric resonator; one end of each of the elastic flaps is fixedly connected to the main cover, and the other end of each of the elastic flaps extends towards a central axis of the dielectric resonator to form a free end; and the free ends of the elastic flaps elastically act on a central part of the outer surface of the main cover, to provide an elastic force towards the dielectric resonator, wherein the TM mode dielectric filter further comprises a tuning screw and a nut; the dielectric resonator is of a hollow columnar structure; and a screw hole is disposed at a center of the main cover, the tuning screw is in threaded connection to the screw hole, one end of the tuning screw is located in the dielectric resonator, and a gap is disposed between the tuning screw and an inner wall of the dielectric resonator; and the nut is in threaded connection to the tuning screw and abuts against the main cover, wherein a second boss is further disposed at a central part of the main cover, and the second boss protrudes along the central axis of the dielectric resonator; the screw hole is disposed in the second boss, the nut abuts against the second boss, and the free ends of the multiple elastic flaps are located on a periphery of the second boss, and wherein in a case in which a first boss is disposed at the central part of the outer surface of the main cover, the second boss is disposed on the first boss, connection between the second boss and the first boss is step-like, and a protruding surface of the first boss is an annular step plane surrounding the second boss.

* * * * *